US011283200B2

(12) United States Patent
Tanaka et al.

(10) Patent No.: US 11,283,200 B2
(45) Date of Patent: Mar. 22, 2022

(54) ELECTRIC WIRE WITH TERMINAL AND METHOD FOR MANUFACTURING SAME

(71) Applicants: SUMITOMO ELECTRIC INDUSTRIES, LTD., Osaka (JP); AUTONETWORKS TECHNOLOGIES, LTD., Yokkaichi (JP); SUMITOMO WIRING SYSTEMS, LTD., Yokkaichi (JP)

(72) Inventors: Shigeyuki Tanaka, Osaka (JP); Taro Fujita, Osaka (JP); Shinya Nishikawa, Osaka (JP); Kazuo Nakashima, Yokkaichi (JP); Tetsuya Nakamura, Yokkaichi (JP)

(73) Assignees: Sumitomo Electric Industies, Ltd., Osaka (JP); AutoNetworks Technologies, Ltd., Yokkaichi (JP); Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 16/624,606

(22) PCT Filed: Dec. 20, 2017

(86) PCT No.: PCT/JP2017/045735
§ 371 (c)(1),
(2) Date: Dec. 19, 2019

(87) PCT Pub. No.: WO2018/235314
PCT Pub. Date: Dec. 27, 2018

(65) Prior Publication Data

US 2020/0119468 A1 Apr. 16, 2020

(30) Foreign Application Priority Data

Jun. 23, 2017 (JP) ..... JP2017-123710

(51) Int. Cl.
*H01R 43/24* (2006.01)
*H01R 4/72* (2006.01)
(Continued)

(52) U.S. Cl.
CPC ..... *H01R 4/72* (2013.01); *H01B 3/441* (2013.01); *H01B 7/02* (2013.01); *H01B 7/285* (2013.01);
(Continued)

(58) Field of Classification Search
None
See application file for complete search history.

(56) References Cited

U.S. PATENT DOCUMENTS 7,959,464 B2 * 6/2011 Mizutani ..... H01R 13/5216 439/588
8,011,976 B2 * 9/2011 Ooki ..... H01R 13/521 439/736
(Continued)

FOREIGN PATENT DOCUMENTS

CN A-104246919 12/2014
JP 2001-95125 A 4/2001
(Continued)

*Primary Examiner* — Felix O Figueroa
(74) *Attorney, Agent, or Firm* — Faegre Drinker Biddle & Reath LLP

(57) ABSTRACT

An electric wire with a terminal, includes an insulated wire which includes a core wire and an insulating layer covering the core wire, a seal member which is disposed in one end portion of the insulated wire and covers the insulating layer, a metal terminal which extends from the end portion of the insulated wire and is connected to the core wire and a waterproof resin portion which covers from a seal member covering part of the insulated wire to an electrical connection part of the metal terminal. The insulating layer contains an olefin resin. The waterproof resin portion contains a polyester, a polyamide, an ethylene-vinyl acetate copolymer,
(Continued)

or a mixed resin thereof. The seal member includes an inner layer containing an ethylene resin and an outer layer laminated on the inner layer and containing a polyester, a polyamide, an ethylene-vinyl acetate copolymer, or a mixed resin thereof.

2 Claims, 4 Drawing Sheets

(51) Int. Cl.

| | |
|---|---|
| ***H01B 3/44*** | (2006.01) |
| ***H01B 7/02*** | (2006.01) |
| ***H01B 7/285*** | (2006.01) |
| ***H01B 13/06*** | (2006.01) |
| ***H01R 43/00*** | (2006.01) |
| ***H01R 13/52*** | (2006.01) |

(52) U.S. Cl.
CPC ..... *H01B 13/06* (2013.01); *H01R 13/5216* (2013.01); *H01R 43/005* (2013.01); *H01R 43/24* (2013.01)

(56) References Cited

U.S. PATENT DOCUMENTS

| | | | | |
|---|---|---|---|---|
| 8,664,528 | B2 | 3/2014 | Ooishi et al. | |
| 9,640,963 | B2 | 5/2017 | Suetani et al. | |
| 10,431,356 | B2 * | 10/2019 | Tachi | H01B 3/28 |
| 2012/0175166 | A1 | 7/2012 | Ooishi et al. | |
| 2012/0205151 | A1 * | 8/2012 | Inoue | C09D 5/082 174/72 A |
| 2015/0047900 | A1 | 2/2015 | Suetani et al. | |
| 2015/0068800 | A1 | 3/2015 | Yamasaki et al. | |
| 2016/0111809 | A1 * | 4/2016 | Kataoka | H01R 13/5205 439/587 |

FOREIGN PATENT DOCUMENTS

| | | | |
|---|---|---|---|
| JP | 2002-184513 | A | 6/2002 |
| JP | 2012-160423 | A | 8/2012 |
| JP | 2013-120699 | A | 6/2013 |
| JP | 2013-187041 | A | 9/2013 |
| JP | 2016-21804 | A | 2/2016 |

* cited by examiner

ELECTRIC WIRE WITH TERMINAL AND METHOD FOR MANUFACTURING SAME

TECHNICAL FIELD

The present invention relates to an electric wire with a terminal and a method for manufacturing the same.

The present application claims priority of Japanese Patent Application No. 2017-123710 filed on Jun. 23, 2017, the entire subject content of which is incorporated herein by reference.

BACKGROUND ART

In a wire harness or the like mounted on an automobile, an electric wire with a terminal is required to be excellent in a waterproof property. As an example of the terminal-equipped electric wire excellent in the waterproof property, there is an electric wire with a terminal, which includes an insulated wire including a conductive core wire and an insulating layer covering an outer periphery of this core wire, a metal terminal which extends from an end portion of the insulated wire and is electrically connected to the core wire of the insulated wire, and a waterproof resin portion which covers at least a part from an insulating layer covering part of the end portion of the insulated wire to an electrical connection part of the metal terminal.

In the electric wire with a terminal, which includes such a waterproof resin portion, an adhesive layer may be provided between the insulating layer and the waterproof resin portion since it is important to improve a water-blocking property between the insulating layer of the insulated wire and the waterproof resin portion. As an electric wire with a terminal provided with this adhesive layer, for example, it has been proposed that aromatic nylon is used for the waterproof resin portion, an olefin resin is used for the insulating layer, and a modified olefin resin which is an olefin resin modified with a polar group is used for the adhesive layer (see JP-A-2013-187041). According to the above literature, when the synthetic resins described above are used for the members in this electric wire with the terminal, the water-blocking property between the insulating layer and the waterproof resin portion is improved by the adhesive layer.

CITATION LIST

Patent Literature

Patent Literature 1: JP-A-2013-187041

SUMMARY OF INVENTION

An electric wire with a terminal according to an aspect of the present disclosure includes: an insulated wire which includes a conductive core wire and an insulating layer covering an outer periphery of the core wire; a cylindrical seal member which is disposed in a vicinity of one end portion of the insulated wire and which covers an outer periphery of the insulating layer; a metal terminal which extends from the end portion of the insulated wire and which is electrically connected to the core wire; and a waterproof resin portion which covers at least a part from a seal member covering part of the insulated wire to an electrical connection part of the metal terminal. The insulating layer contains an olefin resin as a main component, the waterproof resin portion contains a polyester, a polyamide, an ethylene-vinyl acetate copolymer or a mixed resin thereof as a main component, and the seal member includes a cylindrical inner layer containing an ethylene resin as a main component, and an outer layer which is laminated on an outer peripheral side of the inner layer and which contains a polyester, a polyamide, an ethylene-vinyl acetate copolymer or a mixed resin thereof as a main component.

A method of manufacturing an electric wire with a terminal according to another aspect of the present disclosure includes: a heat-shrink tube fitting step of fitting a heat-shrink tube onto a vicinity of one end portion of an insulated wire including a conductive core wire and an insulating layer covering an outer periphery of the core wire; a heating step of heating the fitted heat-shrink tube; a connection step of electrically connecting a metal terminal to a core wire at the end portion of the insulated wire; a disposing step of disposing an inserting portion, which includes a part from a heat-shrink tube covering part of the insulated wire to an electrical connection part of the metal terminal, in a cavity of a mold; and an injection step of filling the cavity with a molten resin composition. The insulating layer contains an olefin resin as a main component, the resin composition contains a polyester, a polyamide, an ethylene-vinyl acetate copolymer, or a mixed resin thereof as a main component, and the heat-shrink tube includes a cylindrical base layer containing an ethylene resin as a main component, and an adhesive layer which is laminated on an outer peripheral side of the base layer and contains a polyester, a polyamide, an ethylene-vinyl acetate copolymer or a mixed resin thereof as a main component.

DESCRIPTION OF EMBODIMENTS

Figure 1:
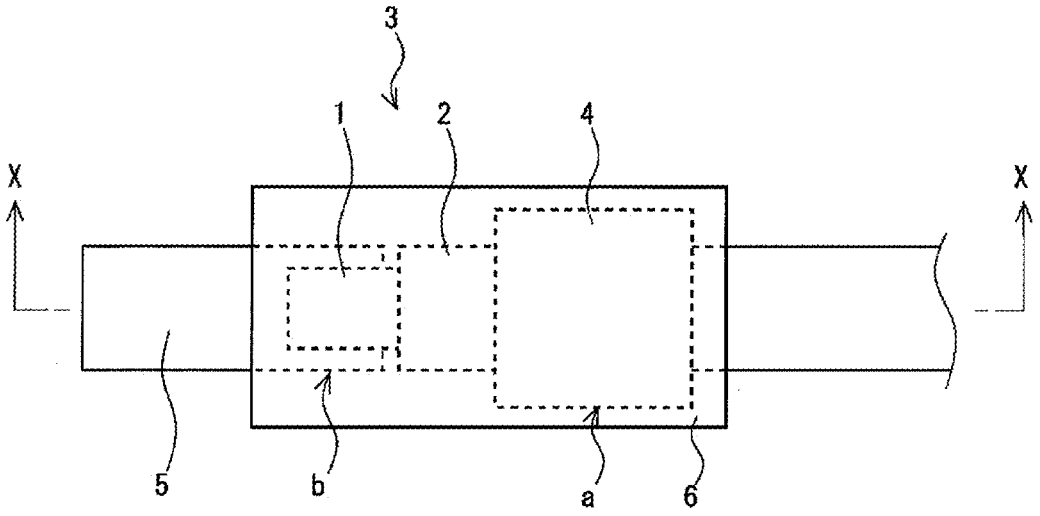
FIG. 1 is a schematic plan view showing an electric wire with a terminal according to an embodiment of the present invention.

Problems to be Solved by Present Disclosure

In recent years, since the use environment of a wire harness or the like mounted on an automobile becomes more and more severe, it is required to further improve a waterproof property compared with the waterproof electric wire with the terminal according to the related art.

The present disclosure has been made in view of the above circumstances, and an object thereof is to provide an electric wire with a terminal, which is excellent in the waterproof property.

Effect of Present Disclosure

An electric wire with a terminal according to an aspect of the present disclosure is excellent in the waterproof property. According to a method of manufacturing the electric wire with the terminal according to another aspect of the present disclosure, an electric wire with a terminal, which is excellent in the waterproof property, can be easily and reliably provided.

Description of Embodiment of Present Invention

An electric wire with a terminal according to an aspect of the present invention includes: an insulated wire which includes a conductive core wire and an insulating layer covering an outer periphery of the core wire; a cylindrical seal member which is disposed in a vicinity of one end portion of the insulated wire and covers an outer periphery of the insulating layer; a metal terminal which extends from the end portion of the insulated wire and is electrically connected to the core wire; and a waterproof resin portion which covers at least a part from a seal member covering part of the insulated wire to an electrical connection part of the metal terminal. The insulating layer contains an olefin resin as a main component, the waterproof resin portion contains a polyester, a polyamide, an ethylene-vinyl acetate copolymer, or a mixed resin thereof as a main component, and the seal member includes a cylindrical inner layer containing an ethylene resin as a main component, and an outer layer which is laminated on an outer peripheral side of the inner layer and which contains a polyester, a polyamide, an ethylene-vinyl acetate copolymer or a mixed resin thereof as a main component.

In the electric wire with the terminal, the seal member is disposed between the insulating layer of the insulated wire and the waterproof resin portion. The seal member has a two-layer structure including an inner layer and an outer layer, and the two layers are bonded in a molten state during extrusion, and therefore, adhesion is high. In addition, the main component of the inner layer is an ethylene resin which is a non-polar resin, and therefore, adhesion between the inner layer and the insulating layer containing an olefin resin which is a non-polar resin as a main component as well is excellent. The main component of the outer layer is a polyester, a polyamide, an ethylene-vinyl acetate copolymer, or a mixed resin thereof as in the waterproof resin portion, and therefore, adhesion between the outer layer and the waterproof resin portion is excellent. In this way, the electric wire with the terminal is excellent in the waterproof property since water immersion to the electrical connection part through an interface between the insulating layer of the insulated wire and the waterproof resin portion is prevented by the seal member exhibiting excellent adhesion to the insulating layer and the waterproof resin portion.

The seal member may be formed of a heat-shrink tube which includes a cylindrical base layer containing an ethylene resin as a main component and an adhesive layer which is laminated on an outer peripheral side of the base layer and which contains a polyester, a polyamide, an ethylene-vinyl acetate copolymer, or a mixed resin thereof as a main component. In this way, when the seal member is formed of the heat-shrink tube, the seal member can be easily and reliably formed. Therefore, manufacturing cost can be reduced, and uniformity of a film thickness of each layer in the seal member can be improved so as to improve the waterproof property.

A method of manufacturing an electric wire with a terminal according to another aspect of the present invention includes: a heat-shrink tube fitting step of fitting a heat-shrink tube onto a vicinity of one end portion of the insulated wire including a conductive core wire and an insulating layer covering an outer periphery of the core wire; a heating step of heating the fitted heat-shrink tube; a connection step of electrically connecting a metal terminal to the core wire at the end portion of the insulated wire; a disposing step of disposing an inserting portion, which includes a part from a heat-shrink tube covering part of the insulated wire to an electrical connection part of the metal terminal, in a cavity of a mold; and an injection step of filling the cavity with molten resin composition. The insulating layer contains an olefin resin as a main component, the resin composition contains a polyester, a polyamide, an ethylene-vinyl acetate copolymer, or a mixed resin thereof as a main component, and the heat-shrink tube includes a cylindrical base layer containing an ethylene resin as a main component, and an adhesive layer which is laminated on an outer peripheral side of the base layer and which contains a polyester, a polyamide, an ethylene-vinyl acetate copolymer or a mixed resin thereof as a main component.

When the method of manufacturing the electric wire with the terminal includes the heat-shrink tube fitting step and the heating step, it is possible to easily and reliably form the electric wire with the terminal including the seal member in the vicinity of the one end portion of the insulated wire. The main component of the inner layer of the seal member is an ethylene resin, and the main component of the outer layer of the seal member is a polyester, a polyamide, an ethylene-vinyl acetate copolymer, or a mixed resin thereof. The electric wire with the terminal is excellent in the waterproof property since water immersion to the electrical connection part through an interface between the insulating layer of the insulated wire and the waterproof resin portion is prevented by the seal member exhibiting excellent adhesion to the insulating layer and the waterproof resin portion.

Here, the term "vicinity of the end portion of the insulated wire" refers to a part within 10 cm from the end portion of the insulating layer. The term "main component" refers to a component with the highest content, for example, a component with a content of 50% by mass or more.

Details of Embodiment of Present Invention

Hereinafter, an electric wire with a terminal according to an embodiment of the present invention and a method of manufacturing the same will be described in detail with reference to the drawings.

<Electric Wire with Terminal>

Figure 2:
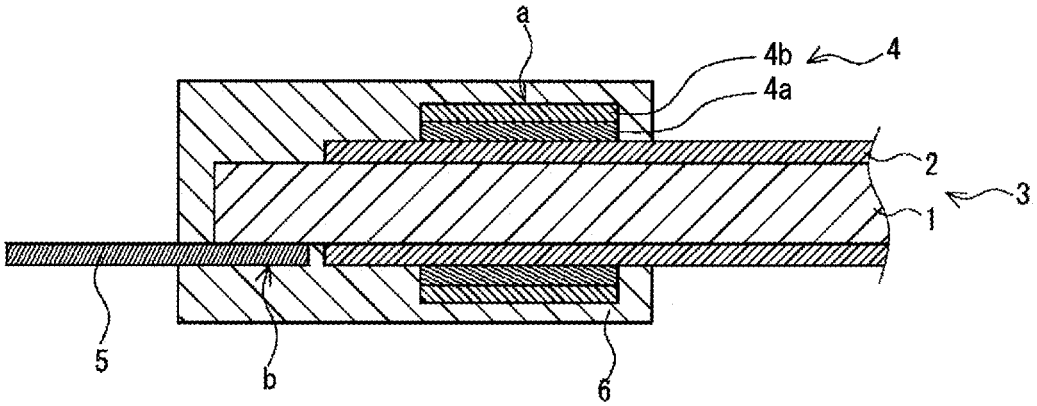
FIG. 2 is a schematic sectional view taken along a line X-X of FIG. 1.

An electric wire with a terminal shown in FIGS. 1 and 2 includes an insulated wire 3 which includes a conductive core wire 1 and an insulating layer 2 covering an outer periphery of the core wire 1; a cylindrical seal member 4 which is disposed in a vicinity of one end portion of the insulated wire 3 and covers an outer periphery of the insulating layer 2; a plate-shaped metal terminal 5 which extends from the end portion of the insulated wire 3 and is electrically connected to the core wire 1; and a waterproof resin portion 6 which covers at least a part from a seal member covering part a of the insulated wire 3 to an electrical connection part b of the metal terminal 5.

[Insulated Wire]

The insulated wire 3 includes the conductive core wire 1 and the insulating layer 2 covering the outer periphery of the core wire 1. In the vicinity of the end portion of the insulated wire 3, the core wire 1 is exposed without being covered with the insulating layer 2. A sectional shape of the insulated wire 3 is not particularly limited, and may be, for example, a circular shape or a rectangular shape.

(Core Wire)

The core wire 1 is a linear member having conductivity, and is formed of a metal wire such as a copper wire, a copper alloy wire, an aluminum wire, or an aluminum alloy wire. The shape of the metal wire is not particularly limited, and for example, a round wire, and a square wire may be used.

The core wire 1 may be a single wire or a twisted wire.

(Insulating Layer)

The insulating layer 2 contains an olefin resin as a main component and covers the outer periphery of the core wire 1. Here, the olefin resin is a synthetic resin having a structural unit derived from olefin compounds in an amount of 50 mol % or more relative to total structural units. Examples of the olefin compounds include ethylene, propylene, butene, butadiene, styrene, and the like. Examples of the olefin resin include polyolefins, for example, polypropylene and polyethylene such as high-density polyethylene, low-density polyethylene, ultralow-density polyethylene, and linear low-density polyethylene, and copolymers of olefin compounds and polar group-containing monomers such as vinyl acetate, ethyl acrylate, butyl acrylate, and methyl acrylate. Examples of the copolymers include an ethylene-vinyl acetate copolymer, ethylene-acrylate copolymers such as an ethylene-methyl acrylate copolymer, an ethylene-ethyl acrylate copolymer, and an ethylene-butyl acrylate copolymer, ethylene methacrylate copolymers such as an ethylene-methyl methacrylate copolymer, an ethylene-ethyl methacrylate copolymer, and an ethylene-butyl methacrylate copolymer, and copolymers of ethylene and unsaturated hydrocarbons having three or more carbon atoms, such as an ethylene-butene copolymer, and an ethylene-octene copolymer. As the olefin resin, a cross-linked olefin resin such as cross-linked polyethylene or cross-linked polypropylene can also be used. The olefin resin is preferably polyethylene, and more preferably low-density polyethylene.

The insulating layer 2 may further contain, as an optional component, a synthetic resin other than the olefin resin, or an additive such as a lubricant, a heat stabilizer, an antioxidant, an anti-aging agent, a nucleating agent, a plasticizer, a cross-linking agent, a releasing agent, a processing aid, an antistatic agent, a filler, and a coloring agent.

[Seal Member]

The seal member 4 is a cylindrical member having a two-layer structure including an inner layer 4*a* and an outer layer 4*b*. The seal member 4 is disposed in the vicinity of one end portion of the insulated wire 3 and covers the outer periphery of the insulating layer 2. The seal member 4 prevents water immersion to the core wire 1 and the electrical connection part b of the metal terminal 5 through the interface between the insulating layer 2 and the waterproof resin portion 6.

A lower limit of an average length of the seal member 4 in an axial direction is preferably 1 mm, and more preferably 5 mm. On the other hand, an upper limit of the average length of the seal member 4 in the axial direction is preferably 50 mm, and more preferably 20 mm. When the average length of the seal member 4 in the axial direction is smaller than the lower limit, the seal member 4 tends to be hardly formed. On the other hand, when the average length of the seal member 4 in the axial direction exceeds the upper limit, the waterproof resin portion 6 may be unnecessarily large. Further, as described below, when the seal member 4 is formed using a commonly known heat-shrink tube, workability at the time of preparing the heat-shrink tube may decrease.

(Inner Layer)

The inner layer 4*a* has a cylindrical shape and contains an ethylene resin as a main component. Since the inner layer 4*a* contains an ethylene resin which is a non-polar resin as a main component, the inner layer 4*a* has excellent adhesion to the insulating layer 2 containing an olefin resin which is also a non-polar resin as a main component. The average thickness of the inner layer 4*a* may be, for example, equal to or more than 0.1 mm and equal to or less than 10 mm.

Here, the ethylene resin is a synthetic resin having a structural unit derived from ethylene in an amount of 50 mol % or more relative to the total structural units. Examples of the ethylene resin include polyethylene such as high-density polyethylene, low-density polyethylene, ultralow-density polyethylene, and linear low-density polyethylene, and copolymers of ethylene and polar group-containing monomers such as vinyl acetate, ethyl acrylate, butyl acrylate, and methyl acrylate. Examples of the copolymers include an ethylene-vinyl acetate copolymer, ethylene-acrylate copolymers such as an ethylene-methyl acrylate copolymer, an ethylene-ethyl acrylate copolymer, and an ethylene-butyl acrylate copolymer, ethylene methacrylate copolymers such as an ethylene-methyl methacrylate copolymer, an ethylene-ethyl methacrylate copolymer, and an ethylene-butyl methacrylate copolymer, and copolymers of ethylene and unsaturated hydrocarbons having three or more carbon atoms, such as an ethylene-butene copolymer, and an ethylene-octene copolymer. As the ethylene resin, a cross-linked ethylene resin such as cross-linked polyethylene can also be used. The ethylene resin is preferably polyethylene, and is more preferably low-density polyethylene.

The inner layer 4*a* may further contain, as an optional component, a synthetic resin other than the ethylene resin, or an additive similar to that exemplified in the insulating layer 2.

(Outer Layer)

The outer layer 4*b* is laminated on an outer peripheral side of the inner layer 4*a*, and contains a polyester, a polyamide, an ethylene-vinyl acetate copolymer, or a mixed resin thereof as a main component. Similar to the waterproof resin portion 6, the outer layer 4*b* contains a polyester, a polyamide, an ethylene-vinyl acetate copolymer, or a mixed resin thereof as a main component, which is a polar resin, and thus has excellent adhesion to the waterproof resin portion 6. Examples of the polyester include polyethylene terephthalate (PET), polybutylene terephthalate (PBT), polytrimethylene terephthalate (PTT), polyethylene naphthalate (PEN), polybutylene naphthalate (PBN), poly(1,4-cyclohexylene dimethylene terephthalate) (PCT), and the like. Examples of the polyamide include polyamide 66 (PA66), polyamide 610 (PA610), polyamide 612 (PA612), polyamide 46 (PA46), polyamide 6T (PA6T), polyamide 6I (PA6I), polyamide 9T (PA9T), polyamide M5T (PAM5T), polyamide 6 (PA6), polyamide 11 (PA11), polyamide 12 (PA12), polyamide MXD6 (PAMXD6), polyamide 6/66 copolymer (PA6/66 copolymer), polyamide 6/12 copolymer (PA6/12 copolymer), polyamide 6/11 copolymer (PA6/11 copolymer), aramids such as polymetaphenylene isophthalamide and polyparaphenylene terephthalamide, and the like. The main component of the outer layer 4*b* is preferably a polyamide and an ethylene-vinyl acetate copolymer. An average thickness of the outer layer 4*b* may be, for example, equal to or more than 50 μm and equal to or less than 2,000 μm.

As a lower limit of the melt mass-flow rate (MFR), at temperature 150° C. and load 2.16 kg, of a polyester, a polyamide, an ethylene-vinyl acetate copolymer or a mixed resin thereof, which is the main component of the outer layer 4*b*, 1 g/10 min is preferred, and 80 g/10 min is more preferred. On the other hand, an upper limit of the MFR is preferably 1,000 g/10 min, and more preferably 800 g/l 0 min. When the MFR is smaller than the lower limit, the adhesion between the outer layer 4*b* of the seal member 4 and the waterproof resin portion 6 tends to decrease. On the other hand, when the MFR exceeds the upper limit, the outer layer 4*b* tends to deform when the waterproof resin portion 6 is formed. Here, "MFR" refers to a value measured in accordance with JIS-K 7210: 1997 "Testing method of melt mass-flow rate (MFR) and melt volume-flow rate (MVR) of plastic-thermoplastic plastic" using an extrusion plastometer specified by JIS-K 6760: 1997 "Polyethylene testing method".

The outer layer 4*b* may further contain, as an optional component, a synthetic resin other than a polyester, a polyamide and an ethylene-vinyl acetate copolymer, and an additive similar to that exemplified in the insulating layer 2.

The seal member 4 may be formed of a heat-shrink tube including a cylindrical base layer containing an ethylene resin as a main component and an adhesive layer which is laminated on an outer peripheral side of the base layer, and contains a polyester, a polyamide, an ethylene-vinyl acetate copolymer, or a mixed resin thereof as a main component. In this way, the seal member 4 can be easily and reliably formed by using the heat-shrink tube. Therefore, manufacturing cost of the electric wire with the terminal can be reduced, and the uniformity of the film thickness of each layer in the seal member 4 can be improved, and as a result, the waterproof property can be further improved.

[Metal Terminal]

The metal terminal 5 is a plate-shaped member extending from the end portion of the insulated wire 3, and is electrically connected to the core wire 1. The metal terminal 5 is used to connect the electric wire with the terminal to a bus bar, a terminal of an electric device, a terminal of another electric wire with a terminal, or the like. Examples of a material of the metal terminal 5 include metal materials similar to those exemplified in the core wire 1.

However, the metal terminal 5 in FIGS. 1 and 2 has a plate shape, and the shape of the metal terminal 5 is not particularly limited. Alternatively, the metal terminal 5 may have another shape such as a rod shape and a cylindrical shape. In addition, an end portion of the metal terminal 5 on a side opposite to the insulated wire 3 side may be electrically connected to another member. Further, a through hole through which a screw or the like is inserted may be provided in the metal terminal 5 in order to make it easy to fix the metal terminal 5 to the core wire 1 or another member.

The metal terminal 5 may be electrically connected to the core wire 1 by coming into contact with each other, or via a conductive layer formed of solder, a conductive adhesive, or the like. The core wire 1 and the metal terminal 5 may be integrated by welding.

[Waterproof Resin Portion]

The waterproof resin portion 6 is a member that protects the core wire 1 and the electrical connection portion b of the metal terminal 5, and contains a polyester, a polyamide, an ethylene-vinyl acetate copolymer or a mixed resin thereof as a main component. The waterproof resin portion 6 at least covers a part from the seal member covering part a of the insulated wire 3 to the electrical connection part b of the metal terminal 5. A shape of the waterproof resin portion 6 is not particularly limited, and may be, for example, a square-columnar shape such as a rectangular shape, and a columnar shape such as a cylindrical shape.

Examples of the synthetic resin as the main component of the waterproof resin portion 6 and an optional component thereof include components similar to those exemplified in the outer layer 4*b* of the seal member 4. The main component of the waterproof resin portion 6 is preferably a polyester and a polyamide, and is more preferably PBT, aramid, PA6T, PA66, and PA6.

[Use]

The terminal-equipped electric wire can be preferably used as a wire harness of an automobile or the like. In addition, the electric wire with the terminal can be preferably used in a place where adhesion of oil such as engine oil and brake oil is assumed since the main component of the waterproof resin portion 6 is a material excellent in oil resistance.

Method of Manufacturing Electric Wire with Terminal

Hereinafter, a preferred method of manufacturing the electric wire with the terminal shown in FIGS. 1 and 2 will be described. The method of manufacturing the electric wire with the terminal shown in FIGS. 3 to 5 includes: a heat-shrink tube fitting step of fitting a heat-shrink tube 7 onto a portion in a vicinity of one end portion of the insulated wire 3 including the conductive core wire 1 and the insulating layer 2 covering the outer periphery of the core wire 1; a heating step of heating the fitted heat-shrink tube 7; a connection step of electrically connecting the metal terminal 5 to the core wire 1 at the end portion of the insulated wire 3; a disposing step of disposing an inserting portion, which includes a part from a heat-shrink tube covering part c of the insulated wire 3 to the electrical connection part b of the metal terminal 5, in a cavity d of a mold 8; and an injection step of filling the cavity d with molten resin composition.

Figure 3:
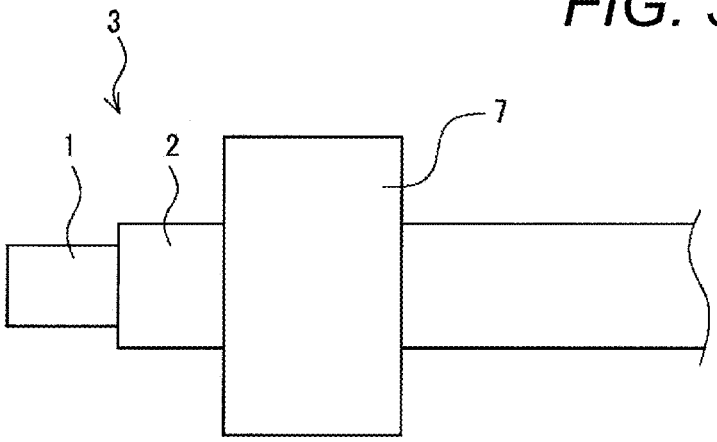
FIG. 3 is a schematic plan view showing a step in a method of manufacturing the electric wire with the terminal of FIG. 1.
Figure 4:
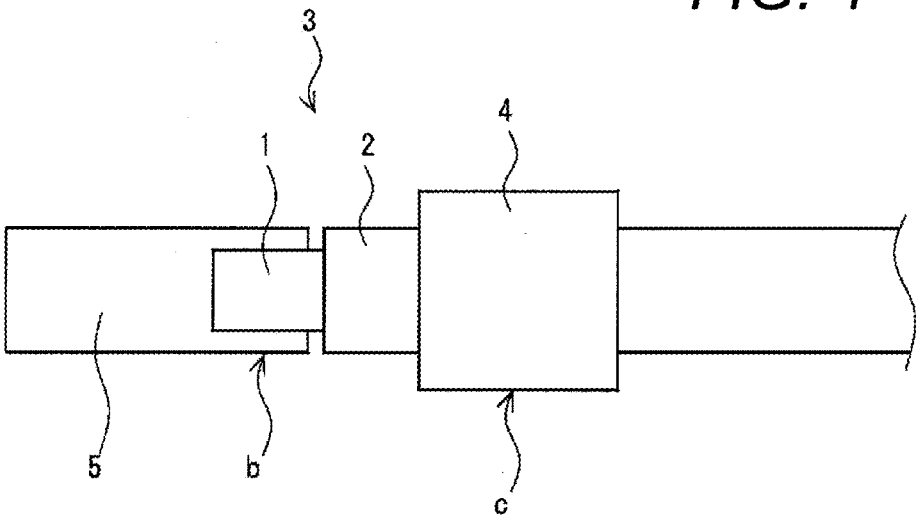
FIG. 4 is a schematic plan view showing a step after the step of FIG. 3.
Figure 5:
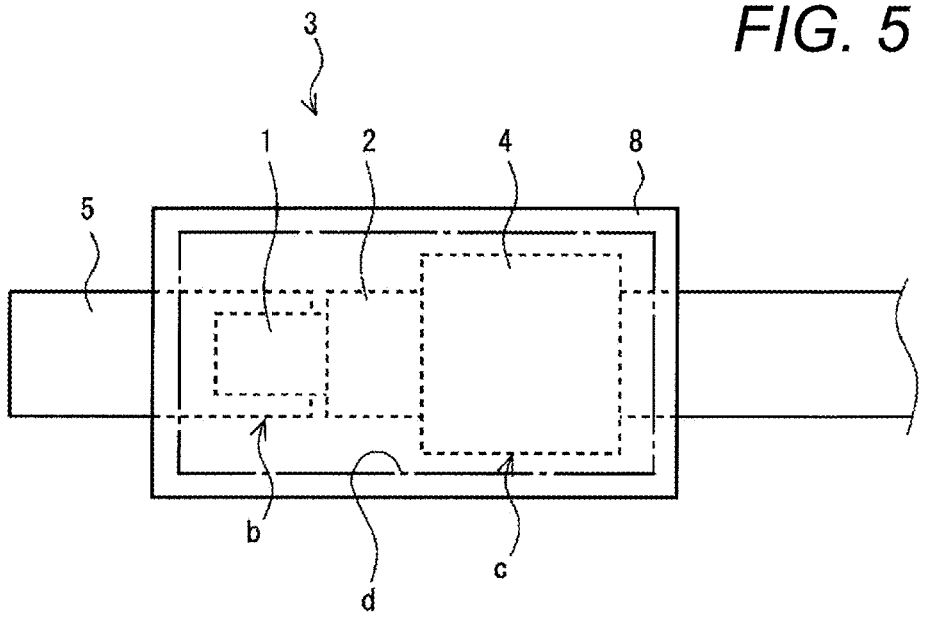
FIG. 5 is a schematic plan view showing a step after the step of FIG. 4.

In the method of manufacturing the electric wire with the terminal shown in FIGS. 3 to 5, the heat-shrink tube fitting step, the heating step, and the connection step are performed in this order. Alternatively, the connection step may be performed at any timing, i.e., before the heat-shrink tube fitting step, between the heat-shrink tube fitting step and the heating step, or after the heating step.

[Heat-Shrinkable Tube Fitting Step]

In the present step shown in FIG. 3, the heat shrinkable-tube 7 is fitted onto a portion in the vicinity of one end portion of the insulated wire 3 which includes the conductive core wire 1 and the insulating layer 2 covering the outer periphery of the core wire 1. The insulated wire 3 used in the present step has already been described in the electric wire with the terminal, and thus a repetitive description will be omitted.

(Heat-Shrinkable Tube)

The heat-shrink tube 7 includes a cylindrical base layer containing an ethylene resin as a main component and an adhesive layer which is laminated on the outer peripheral side of this base layer and contains a polyester, a polyamide, an ethylene-vinyl acetate copolymer, or a mixed resin thereof as a main component, and a diameter of the heat-shrink tube 7 is reduced by heating. Synthetic resins, which are the main components of the base layer and the adhesive layer of the heat-shrink tube 7, and optional components thereof may be similar to those exemplified in the inner layer 4*a* and the outer layer 4*b* of the seal member 4 of the electric wire with the terminal.

Figure 6A:
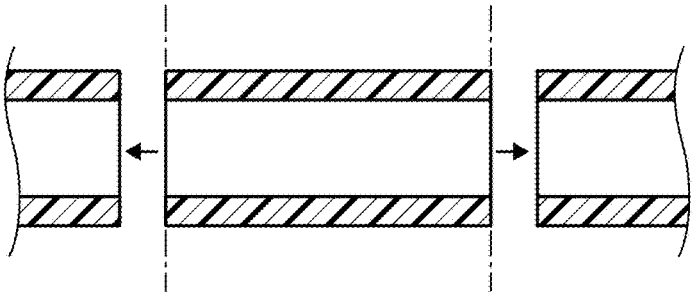
FIGS. 6A to 6E are cross-sectional views showing a method of preparing a heat-shrink tube of the present embodiment from a common heat-shrink tube.
Figure 6B:
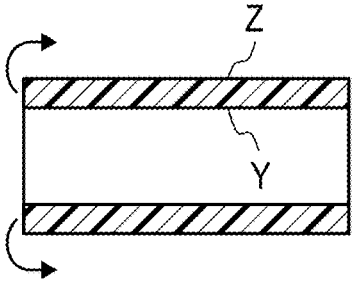
Figure 6C:
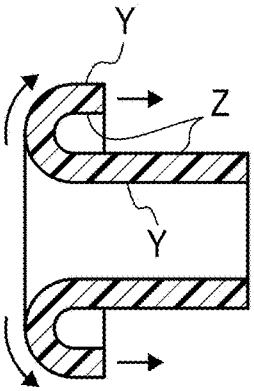
Figure 6D:
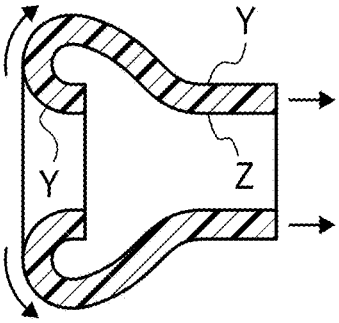
Figure 6E:
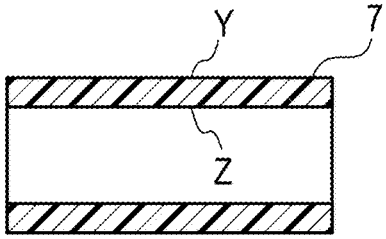

Here, a layer corresponding to the adhesive layer is laminated on an inner peripheral side of a layer corresponding to the base layer in a common heat-shrink tube. That is, the common heat-shrink tube has inner and outer layers whose position relationship is opposite to that of the heat-shrink tube 7 used in the present step. Therefore, in the method for manufacturing the electric wire with the terminal, the heat-shrink tube 7 used in the present step may be prepared by cleaving the common heat-shrink tube to have a desired length and turning over the common heat-shrink tube from one end portion (see FIGS. 6A to 6E). Specifically, as shown in FIG. 6A, a common heat-shrink tube is cleaved to have a desired length. Then, as shown in FIGS. 6B to 6E, the cleaved common heat-shrink tube is turned inside out from one end portion to obtain the heat-shrink tube 7. Accordingly, although a surface Z of the heat-shrink tube is on the outer side and a surface Y of the heat-shrink tube is on the inner side in FIG. 6B, a surface Z of the heat-shrink tube is on the inner side and a surface Y of the heat-shrink tube is on the outer side in FIG. 6E. As a result, the heat-shrink tube 7 used in the present step can be easily formed from the common-heat shrinkable tube.

In the method for manufacturing the common heat-shrink tube, it is difficult to directly manufacture the heat-shrink tube 7 used in the present step. This is because a multilayer body including a layer corresponding to a cylindrical base layer and a layer corresponding to an adhesive layer laminated on the inner peripheral side of this layer is first prepared, inner pressure is applied by inserting a cylinder or the like into the multilayer body while heating the multilayer body so as to increase an diameter thereof, and then the diameter-increased multilayer body is fixed in this shape, in manufacturing of the common heat-shrink tube. In order to directly manufacture the heat-shrink tube 7 used in the present step according to this method, it is necessary to make the layer structure of the multilayer body to be prepared opposite on the inner side and the outer side. This is because the layer corresponding to the adhesive layer on the outer side tends to melt when the cylinder or the like is inserted into the multilayer body, and the multilayer body is likely to be out of shape.

The heat-shrink tube 7 preferably has an inner diameter smaller than an outer diameter of the insulated wire 3 after heat shrinkage. The formed seal member 4 tightens the insulated wire 3 in a radial direction by using the heat-shrink tube 7, so that the adhesion between the inner layer 4*a* of the seal member 4 and the insulating layer 2 of the insulated wire 3 can be further improved. As an upper limit of a ratio of the inner diameter of the heat-shrink tube 7 after the heat shrinkage to the outer diameter of the insulated wire 3 (inner diameter of heat-shrink tube after the heat shrinkage/outer diameter of insulated wire 3), 0.9 is preferred, and 0.8 is more preferred. On the other hand, a lower limit of the above ratio is preferably 0.5.

[Heating Step]

In the present step, the heat-shrink tube 7 fitted by the heat-shrink tube fitting step is heated. As a result, the heat-shrink tube 7 is reduced in diameter and covers the insulated wire 3, so that the inner layer 4*a* of the seal member 4 is formed from the base layer, and the outer layer 4*b* of the seal member 4 is formed from the adhesive layer. The method of heating the heat-shrink tube 7 in the present step is not particularly limited, and examples thereof include a method of applying hot air by a heat gun or the like, a method of disposing the heat-shrink tube 7 in a constant temperature bath which is set at desired temperature, and the like.

In the method of manufacturing the electric wire with the terminal, the seal member 4 can be formed by the heat-shrink tube fitting step and the heating step, and a relatively time-consuming step such as the step of applying a resin composition for the formation of the seal member 4 can be omitted. Therefore, the electric wire with the terminal can be easily and reliably manufactured.

[Connection Step]

In the present step shown in FIG. 4, the metal terminal 5 is electrically connected to the core wire 1 at the end portion of the insulated wire 3 after the heating step. The metal terminal 5 used in the present step has already been described in the electric wire with the terminal, and thus a repetitive description will be omitted.

Examples of a method of electrically connecting the metal terminal 5 to the core wire 1 in the present step include a method of simply bringing the metal terminal 5 into contact with the core wire 1, a method of bonding the metal terminal 5 to the core wire 1 by soldering, a conductive adhesive or the like, a method of welding the metal terminal 5 to the core wire 1 by ultrasonic welding or the like, and the like.

[Disposing Step]

In the present step shown in FIG. 5, the inserting portion including a part from the heat-shrink tube covering part c of the insulated wire 3 to the electrical connection part b of the metal terminal 5 is disposed in the cavity d of the mold 8 after the connection step.

[Injection Step]

In the present step, the cavity d of the mold 8, in which the inserting portion is disposed, is filled with molten resin composition after the disposing step. As the resin composition used for the present step, a resin having the same composition as that of the waterproof resin portion 6 of the electric wire with the terminal can be used. Examples of a method of filling the cavity d of the mold 8 with the molten resin composition in the present step include an injection molding method, a transfer molding method, and the like.

In the present step, the inserting portion is covered with the molten resin composition, and then the resin composition is solidified by cooling, so as to form the waterproof resin portion 6. In the present step, the cavity d of the mold 8 is filled with the molten resin composition, and thereby the outer layer 4*b* of the seal member 4 is temporarily softened, and excellent adhesion between the seal member 4 and the formed waterproof resin portion 6 can be exhibited. After the present step, the mold 8 is removed to obtain the electric wire with the terminal shown in FIGS. 1 and 2.

Other Embodiments

It should be understood that the embodiments disclosed herein are illustrative and non-restrictive in every respect. The scope of the present invention is not limited to the configuration of the above embodiment and is shown by the claims, and the present invention is intended to include all modifications within the meaning and scope equivalent to the claims.

In the terminal-equipped electric wire, a metal terminal may be electrically connected to two end portions of the insulated wire. In addition, the seal member may further include another layer laminated between the inner layer and the outer layer. The insulating layer of the insulated wire may have a multilayer structure.

As a method of forming the seal member of the electric wire with the terminal, for example, a method of applying a resin composition may be used in addition to the method using the heat-shrink tube described in the method of manufacturing the electric wire with the terminal.

EXAMPLES

Hereinafter, the present invention will be more specifically described by way of examples, but the present invention is not limited to the following examples.

[Production of Electric Wire with Terminal]

An electric wire with a terminal No. 1 in Table 1 (electric wire with terminal No. 1) was produced as follows.

A stranded structure (outer diameter of conductor: 5.5 mm), which was obtained by twisting 30 wires having a diameter of 0.18 mm (conductor: 15 sq) to form a stranded wire and then twisting 19 stranded wires, was used as a core wire, and low-density polyethylene was extruded and coated on the core wire to form an insulating layer having a thickness of 1.25 mm, so as to obtain an insulated wire (outer diameter of electric wire: 8 mm). Next, with the obtained insulated wire, the waterproof resin portion was formed by using PBT, the inner layer of the seal member was formed by using low-density polyethylene, the outer layer of the seal member was formed by using a polyamide, and thereby the electric wire with the terminal No. 1 was obtained.

(Electric Wires with Terminals No. 2 to No. 8)

Electric wires with terminals No. 2 to No. 8 were produced in the same manner as that of the electric wire with the terminal No. 1 except that the insulating layer of the insulated wire, the waterproof resin portion, and the inner layer and the outer layer of the seal number used for electric wires with terminals No. 2 to No. 8 were formed by using resins described in the following Tables 1 and 2.

[Evaluation]

The waterproof properties of electric wires with terminals No. 1 to No. 8 were evaluated according to the following method. The evaluation results are shown in Tables 1 and 2.

(Waterproof Property)

The produced t electric wire with the terminal was put into a heat resistance tester and was placed at 150° C. for 500 hours, an terminal end portion of a waterproof resin portion of the electric wire with the terminal was sealed, compressed air of 0.2 MPa was fed from the back end portion of the wire in water and the presence and absence of air bubbles from the electric wire end portion of the waterproof resin portion was confirmed, and thereby the waterproof property of the electric wire with the terminal was evaluated. The case where the air bubbles were not confirmed was evaluated as "good" and the case where the air bubbles were confirmed was evaluated as "poor".

TABLE 1

| | Electric wire with terminal | | | |
|---|---|---|---|---|
| | No. 1 | No. 2 | No. 3 | No. 4 |
| Insulating layer of insulated wire | Low-density polyethylene | Low-density polyethylene | Low-density polyethylene | Low-density polyethylene |
| Waterproof resin portion | PBT | PBT | PBT | PBT |
| Inner layer of seal member | Low-density polyethylene | Low-density polyethylene | Polyamide | Ethylene-vinyl acetate copolymer |
| Outer layer of seal member | Polyamide | Ethylene-vinyl acetate copolymer | Low-density polyethylene | Low-density polyethylene |
| Waterproof property | Good | Good | Poor | Poor |

TABLE 2

| | Electric wire with terminal | | | |
|---|---|---|---|---|
| | No. 5 | No. 6 | No. 7 | No. 8 |
| Insulating layer of insulated wire | Low-density polyethylene | Low-density polyethylene | Low-density polyethylene | Low-density polyethylene |
| Waterproof resin portion | PA6T | PA6T | PA6T | PA6T |
| Inner layer of seal member | Low-density polyethylene | Low-density polyethylene | Polyamide | Ethylene-vinyl acetate copolymer |
| Outer layer of seal member | Polyamide | Ethylene-vinyl acetate copolymer | Low-density polyethylene | Low-density polyethylene |
| Waterproof property | Good | Good | Poor | Poor |

From results of Tables 1 and 2, it can be seen that the electric wires with the terminals No. 1, No. 2, No. 5, and No. 6 were excellent in the waterproof property, in which the above resins were used as the main components of the insulating layer of the insulated wire, the waterproof resin portion, and the inner and outer layers of the seal member. On the other hand, the electric wires with the terminals No. 3, No. 4, No. 7, and No. 8 were poor in the waterproof property, in which the above resins were not used as the main components of the inner and outer layers of the seal member.

INDUSTRIAL APPLICABILITY

An electric wire with the terminal according to an aspect of the present invention is excellent in the waterproof property. According to a method for manufacturing the electric wire with the terminal according to another aspect of the present invention, an electric wire with a terminal excellent in the waterproof property can be easily and reliably provided.

REFERENCE SIGNS LIST

1 Core wire
2 Insulating layer
3 Insulated wire
4 Seal member
4*a* Inner layer
4*b* outer layer
5 Metal terminal
6 Waterproof resin portion
7 Heat-shrink tube
8 Mold
a Seal member covering part
b Electrical connection part
c Heat-shrink tube covering part
d Cavity

The invention claimed is:

1. An electric wire with a terminal, comprising:

an insulated wire which includes a conductive core wire and an insulating layer covering an outer periphery of the core wire;

a cylindrical seal member which is disposed in a vicinity of one end portion of the insulated wire and which covers an outer periphery of the insulating layer;

a metal terminal which extends from the end portion of the insulated wire and which is electrically connected to the core wire; and a waterproof resin portion which covers at least a part from a seal member covering part of the insulated wire to an electrical connection part of the metal terminal, wherein the insulating layer contains an olefin resin as a main component, wherein the waterproof resin portion contains a polyester, a polyamide, an ethylene-vinyl acetate copolymer, or a mixed resin thereof as a main component, wherein the seal member is formed of a heat-shrink tube which includes:

a cylindrical base layer containing an ethylene resin as a main component and being in contact with the insulating layer; and an adhesive layer which is laminated on an outer peripheral side of the base layer, which contains a polyester, an ethylene-vinyl acetate copolymer, or a mixed resin of polyester and ethylene-vinyl acetate copolymer as a main component, and which is in contact with the waterproof resin portion, and wherein the adhesive layer is not in contact with the core wire and the metal terminal.

2. A method of manufacturing an electric wire with a terminal, the method comprising:

cleaving a heat-shrink tube to have a predetermined length and then turning the cleaved heat-shrink tube inside out;

fitting the turned inside out heat-shrink tube onto a vicinity of one end portion of an insulated wire including a conductive core wire and an insulating layer covering an outer periphery of the core wire;

heating the fitted heat-shrink tube;

electrically connecting a metal terminal to the core wire at the end portion of the insulated wire;

disposing an inserting portion, which includes a part from the heat-shrink tube covering part of the insulated wire to an electrical connection part of the metal terminal, in a cavity of a mold; and filling the cavity with molten resin composition, wherein the insulating layer contains an olefin resin as a main component, wherein the resin composition contains a polyester, a polyamide, an ethylene-vinyl acetate copolymer, or a mixed resin thereof as a main component, and wherein the turned inside out heat-shrink tube includes:

a cylindrical base layer containing an ethylene resin as a main component, and an adhesive layer which is laminated on an outer peripheral side of the base layer and which contains a polyester, an ethylene-vinyl acetate copolymer, or a mixed resin of polyester and ethylene-vinyl acetate copolymer as a main component.

* * * * *